United States Patent [19]

Kruppert

[11] Patent Number: 4,575,054

[45] Date of Patent: Mar. 11, 1986

[54] APPARATUS FOR QUENCHING STEEL PIPES

[75] Inventor: Frederick W. Kruppert, Goulais River, Canada

[73] Assignee: Kruppert Enterprises, Inc., Goulais River, Canada

[21] Appl. No.: 588,986

[22] Filed: Mar. 13, 1984

Related U.S. Application Data

[63] Continuation of Ser. No. 346,755, Feb. 8, 1982, abandoned.

[51] Int. Cl.[4] ..... C21D 1/62

[52] U.S. Cl. ..... 266/114; 266/117; 266/134; 266/259; 148/153

[58] Field of Search ..... 266/114, 115, 117, 111–113, 266/130, 134; 134/122 R; 62/64; 148/143, 153, 155, 156

[56] References Cited

U.S. PATENT DOCUMENTS

| | | | |
|---|---|---|---|
| 2,888,374 | 5/1959 | Heinenberg | 148/21 |
| 3,212,766 | 10/1965 | Heinenberg | 266/6 |
| 3,380,725 | 4/1968 | Gubert et al. | 266/6 |
| 3,623,716 | 11/1971 | Fritsch et al. | 266/6 |
| 3,650,282 | 3/1972 | Hollyer | 134/122 |
| 3,877,685 | 4/1975 | Franceschina et al. | 266/4 |
| 4,065,252 | 12/1977 | Hemsath et al. | 432/77 |
| 4,110,092 | 8/1978 | Kunioka et al. | 62/64 |
| 4,116,716 | 9/1978 | Itoh et al. | 134/134 |
| 4,149,913 | 4/1979 | Kunioka et al. | 148/153 |
| 4,165,246 | 8/1979 | Reinke et al. | 148/153 |
| 4,376,528 | 3/1983 | Ohshimatani et al. | 266/114 |

FOREIGN PATENT DOCUMENTS

| | | | |
|---|---|---|---|
| 355244 | 4/1952 | Fed. Rep. of Germany . | |
| 2703852 | 8/1978 | Fed. Rep. of Germany . | |
| 3138274 | 11/1980 | Fed. Rep. of Germany . | |
| 1204662 | 1/1960 | France . | |
| 1381458 | 10/1963 | France . | |
| 54-127336 | 10/1979 | Japan . | |
| 6417 | 1/1980 | Japan | 266/114 |
| 55-117432 | 8/1980 | Japan . | |
| 1097029 | 12/1967 | United Kingdom . | |
| 1341255 | 12/1973 | United Kingdom . | |
| 382697 | 5/1971 | U.S.S.R. | 266/114 |

*Primary Examiner*—Christopher W. Brody
*Attorney, Agent, or Firm*—Arnold, White & Durkee

[57] ABSTRACT

An apparatus is provided for quenching a hollow-bodied piece of steel with an opening at each end thereof, such as a steel pipe, which comprises exterior and interior quenching means. The exterior quenching means includes means for directing a cooling medium in a substantially circumferential flow pattern around the exterior of a steel pipe. In one embodiment the exterior quenching means includes means for separately directing a cooling medium in a substantially circumferential flow pattern at variable flow rates around the exterior segments of a steel pipe. The flow rate around each pipe segment may be varied with the thickness of the segment. The exterior cooling means may comprise a plurality of deflector plates to achieve the circumferentially directed flow of the cooling medium about the pipe. The interior quenching means includes means for injecting a gas into a cooling medium to insure sufficient turbulence in the cooling medium as it passes through the interior of the pipe so that heat transfer from the pipe to the cooling medium is facilitated. In one embodiment, the interior quenching means includes a cooling medium conduit adapted to introduce a cooling medium into the pipe and a gas injection conduit adapted to blow a gas into the cooling medium as it enters the pipe from the cooling medium conduit.

9 Claims, 10 Drawing Figures

APPARATUS FOR QUENCHING STEEL PIPES

This is a continuation of application, Ser. No. 346,755, filed Feb. 8, 1982 now abandoned.

BACKGROUND OF THE INVENTION

The present invention relates to an apparatus and method for hardening steel and more particularly to a method and apparatus for quenching steel pipes of substantial and varying thicknesses.

Quenching is one of the oldest and most common methods of hardening steel by heat treatment. It consists of heating the steel above its critical transformation temperature at which a component known as austenite begins to form, and then cooling it fast enough, usually by quenching into a liquid such as water or oil, to avoid any transformation of the austenite until it reaches the relatively low temperature range within which it transforms to a hard martensite. The steel is subsequently reheated or tempered to remove the internal stresses caused by the inherent expansion of the martensite.

The quenching of steel from its critical transformation temperature to the martensitic transformation temperature requires a rather severe cooling rate if the formation of pearlite is to be avoided. Given the importance of the cooling rate in producing the desired properties, the production of large pieces of steel has always presented particular difficulties, since the temperature drop at the center of a given piece of steel lags the temperature drop at the surface.

A number of processes have been developed in an attempt to address this problem. For example, metal alloys, such as manganese, silicon, nickel or chromium have been added to retard the formation of pearlite to allow for an initial lower quench and to enhance in other ways the final properties of the steel. However, the use of alloys adds considerably to the expense of the steel.

A variety of methods and devices have been developed or suggested as ways of more readily controlling heat transfer from both the exterior and interior surfaces of pipes by using water, as well as other substances, as a cooling medium. These prior processes employ a variety of sprays and flow schemes. For example, in U.S. Pat. No. 3,212,766 there is disclosed an apparatus for quenching a long tube. The apparatus comprises a cooling bath, in which a tube is immersed, and a coolant vortical-flow-inducing nozzle. The nozzle forces a vortical flow of coolant through the interior of the tube.

U.S. Pat. No. 3,623,716 discloses an apparatus for hardening long pipes. The pipe is immersed in a tank equipped with a nozzle arranged for introducing a cooling medium into the interior of the pipe in such a manner that cooling medium is drawn from the exterior of the pipe to the interior of the pipe.

U.S. Pat. No. 3,877,685 discloses an apparatus for quenching a steel pipe with a cooling medium including an isolator which is in fluid communication with a retractable nozzle. The isolator and retractable nozzle cooperate so that the relative proportion of cooling liquid passing into the pipe and around the pipe may be varied. The flow of cooling medium is directed along the longitudinal axis of the steel pipe.

U.S. Pat. No. 4,165,246 discloses a process for heat treating steel pipes with a wall thickness ranging from 16 to 36 mm. After the steel pipe is heated, it is passed on rollers to a cooling zone while water directed from nozzles encircling the pipe quench the surface below the martensitic transformation temperature.

U.S. Pat. No. 4,116,716 discloses an immersion cooling apparatus including a cooling tank containing cooling liquid, a mechanism for locking the immersed pipe in position, and a nozzle extending toward the interior of the pipe in the direction of the pipe axis.

These and other devices and methods, which employ a variety of quenching mechanisms using cooling baths and the like, suffer from one or more of several limitations. For example, these devices and methods often fail to provide a sufficiently severe quench, so that the thickness of steel pipe which may be successfully treated is limited. Likewise, the strength and other properties attainable for a given thickness of pipe are limited. Also, many devices and methods do not provide uniform cooling or cannot accommodate a steel piece of varying thickness such as upset pipe. Additionally, sonic devices cannot vary the character of the quench from segment to segment or along the length of a pipe.

These and other limitations of prior processes and methods are substantially minimized if not eliminated by the present invention.

SUMMARY OF THE INVENTION

According to the present invention there is provided an apparatus for quenching a hollow-bodied piece of steel, with an opening at each end thereof, such as a steel pipe, which comprises exterior and interior quenching means. The exterior quenching means includes means for directing a cooling medium in a substantially circumferential flow pattern around the exterior of the piece of steel. In one embodiment, the exterior quenching means includes means for separately directing a cooling medium in a substantially circumferential flow pattern at variable flow rates around exterior segments of a steel pipe. The flow rate around each pipe segment may be varied with the thickness of the segment. The exterior quenching means may employ a plurality of deflector plates to achieve the circumferentially directed flow of the cooling medium about the pipe.

The interior quenching means includes means for injecting a gas into a cooling medium to insure sufficient turbulence in the cooling medium as it passes through the interior of the pipe so that heat transfer from the pipe to the cooling medium is facilitated. In one embodiment, the interior quenching means includes a cooling medium conduit adapted to introduce a cooling medium into the pipe and a gas injection conduit adapted to blow a gas into the cooling medium as it enters the pipe from the cooling medium conduit.

The quenching apparatus may include a clamp engageable with the pipe to prevent its substantial movement as it undergoes quenching. For example, the clamp may include a single clamping member attached to one end of the pipe.

In another embodiment, there is provided an apparatus for quenching the interior and exterior of a steel pipe including an exterior quenching means for contacting the exterior surfaces of the pipe with a cooling medium and an interior quenching means. The interior quenching means includes a cooling medium conduit located along the axis of the pipe but having a tapered outlet adapted to direct the cooling medium into the interior of the pipe, a gas conduit telescopically mated in the cooling medium conduit and having a gas conduit outlet near the tapered outlet of the cooling medium conduit, and a series of helical vanes mounted in the interior of the cooling medium conduit and adapted to impart a helical flow pattern to the cooling medium leaving the tapered outlet. The gas conduit outlet is adapted to inject the gas from the gas conduit into the cooling medium.

In yet another embodiment, there is provided an apparatus for quenching the interior and exterior of the steel pipe including an interior quenching means for contacting the interior surface of the pipe with a cooling medium, a U-shaped receptacle having a sufficient length to receive the pipe and having a plurality of openings passing through its wall, and an exterior quenching means. The exterior quenching means includes a plurality of compartments formed by contoured supports longitudinally spaced along the inside surface of the receptacle, a flow chamber mounted on the exterior surface of each compartment and adapted to place a cooling medium inlet in communication with at least a portion of the openings passing through the receptacle and a plurality of deflectors. The contoured supports have a movable portion for lifting a pipe from the receptacle and the deflectors are adapted to direct the cooling medium through the receptacle openings in a circumferential pattern along the exterior surface of that portion of the pipe in each compartment. The apparatus may also be provided with an upper deflector plate mounted on the receptacle and adapted to facilitate the circumferential flow of the cooling medium about the upper exterior surface of the pipe.

Also in accordance with the present invention, there is provided a process for quenching a hollow-bodied piece of steel with an opening at each end thereof, such as a steel pipe, including the steps of separately directing a cooling medium in a substantially circumferential flow pattern against the exterior segments of the pipe while concurrently passing the cooling medium through the interior of the pipe wherein a gas is injected into the cooling medium to insure sufficient turbulence in the cooling medium as it passes through the interior of the pipe to facilitate heat transfer to the cooling medium. In alternative embodiments either the interior or exterior quenching steps may be employed with other quenching processes such as complete immersion or the passage of a non-gaseous cooling medium along the longitudinal axis of the pipe.

In accordance with the present invention, there is also provided a method of heat treating a steel pipe including the steps of heating the pipe to a temperature sufficiently above its austenizing temperature to avoid cooling below the critical transformation temperature until the pipe is placed in a receptacle; filling the receptacle with a sufficient amount of water to cushion the pipe as it enters the receptacle; placing the pipe in the receptacle; clamping the pipe in the receptacle; directing water in a substantially circumferential flow pattern around the exterior of the pipe and concurrently therewith passing water through the interior of the pipe in a generally helical flow pattern wherein air is injected into the water to insure sufficient turbulence in the water as it passes through the interior of the steel pipe to facilitate heat transfer to the water; and lifting the pipe from the receptacle after the pipe is sufficiently cooled. The flow rate of the water directed around the exterior of the pipe may be varied according to the thickness of the segment of pipe the water flows around. The water may be circumferentially circulated in the receptacle prior to placing the pipe in the receptacle, and the water circulating around the exterior of the pipe may be continually replenished.

The water used for both interior and exterior quenching should be maintained at a temperature of 80° F. or less. Further, the water passing through the interior of the pipe should be at a pressure in the range of 60 to 110 psi.

Examples of the more important features of this invention have thus been summarized rather broadly in order that the detailed description thereof that follows may be better understood, and in order that the contribution to the art may be better appreciated. There are, of course, additional features of the invention that will be described hereinafter and which will also form the subject of the claims appended hereto.

Figure 1:
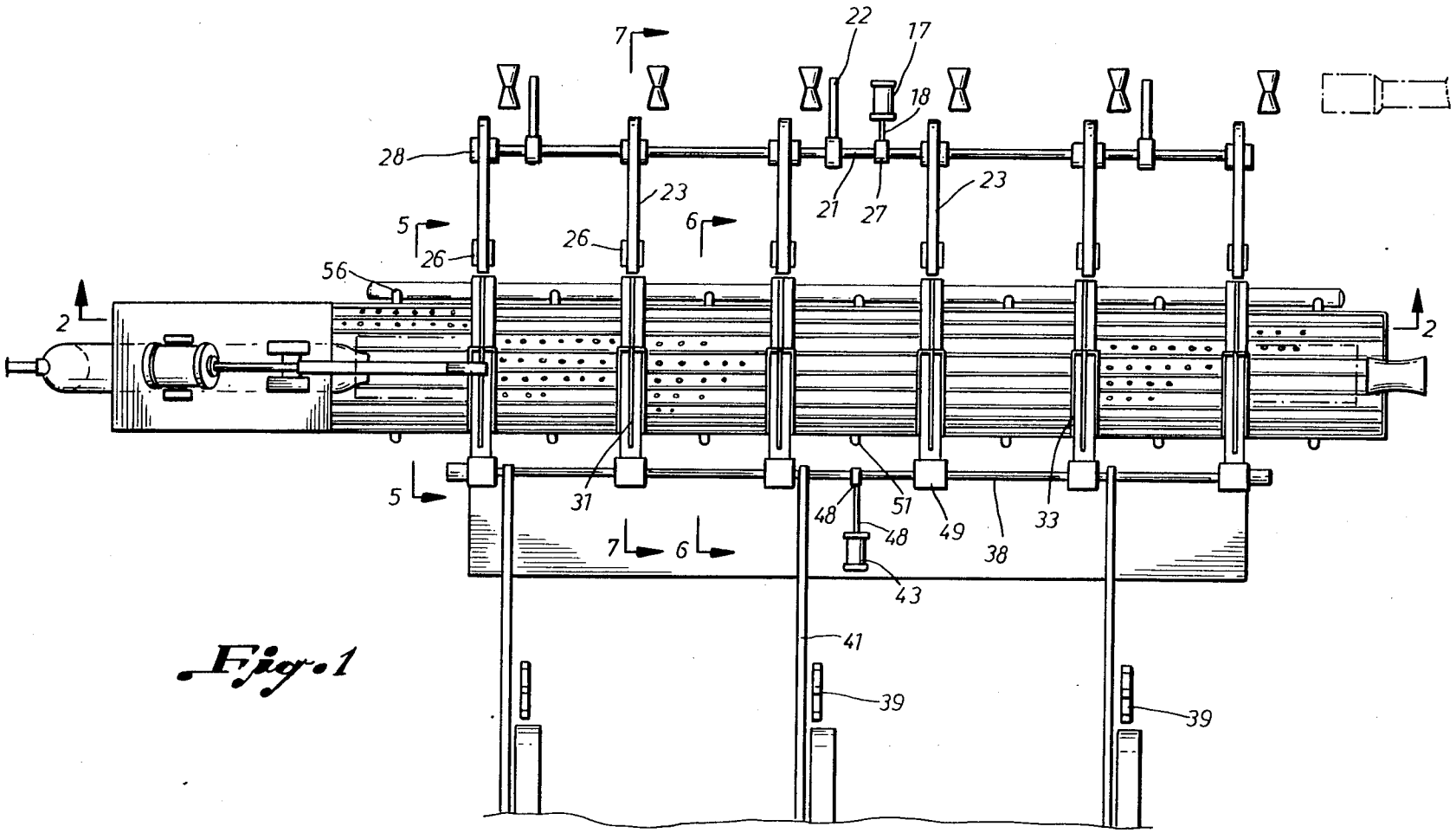
FIG. 1 is a plan view of a preferred embodiment of the present invention.
Figure 2:
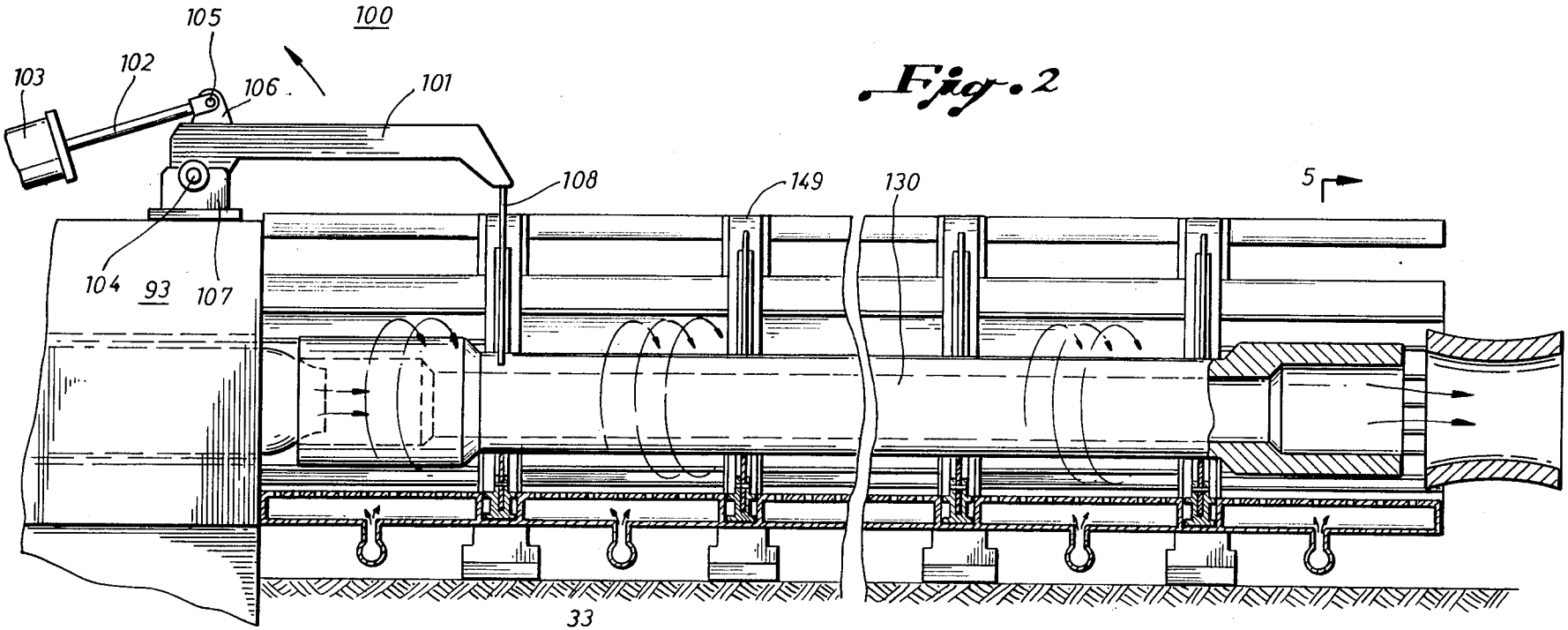
FIG. 2 is an elevation view of the embodiment depicted in FIG. 1.
Figure 4:
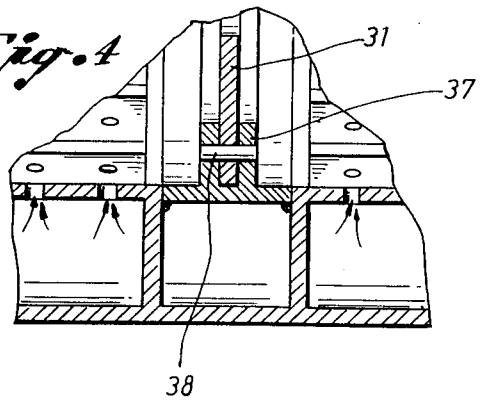
FIG. 4 is a closeup view of a portion of the embodiment of FIGS. 1, 2, and 7, taken along line 4—4 of FIG. 7.
Figure 3:
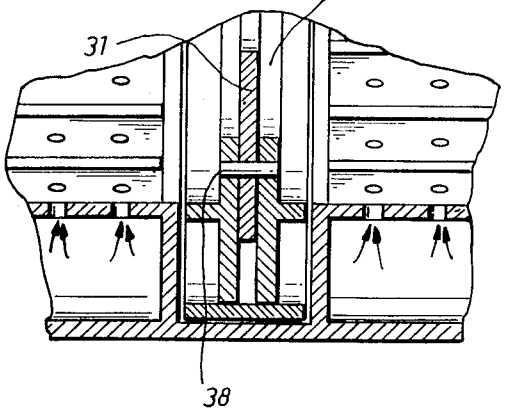
FIG. 3 is a closeup view of a portion of the embodiment shown in FIG. 2.

Reference to these drawings will further explain the invention when taken in conjunction with the description of the preferred embodiments.

DESCRIPTION OF THE PREFERRED EMBODIMENTS

Referring generally now to FIGS. 1–10, there will now be described a device and method of quenching steel pipe in accordance with the present invention. Generally, the apparatus may include a feed mechanism 10, a pipe receptacle 30, an unloading mechanism 40, a cooling medium source 50, an exterior quenching means 70, an internal quenching means 80, and a clamp 100.

The feed mechanism 10 is adapted to place a pipe 130 into receptacle 30, which is adapted to hold the pipe in place in conjunction with clamp 100. Exterior quenching means 70 is connected to cooling medium source 50 and adapted to direct a cooling medium such as water in a substantially circumferential flow pattern around exterior segments of the pipe in the receptacle. The exterior quenching means 70 may be adapted in conjunction with cooling medium source 50 to provide variable flow rates to differing segments of the pipe. Internal quenching means 80 is also connected to a cooling medium source and is adapted to concurrently pass a cooling medium through the interior of the pipe as it is in the receptacle. Interior quenching means 80 includes means for injecting a gas into the cooling medium to insure sufficient turbulence in the cooling medium as it passes through the pipe to facilitate heat transfer from the pipe to the cooling medium.

Figure 7:
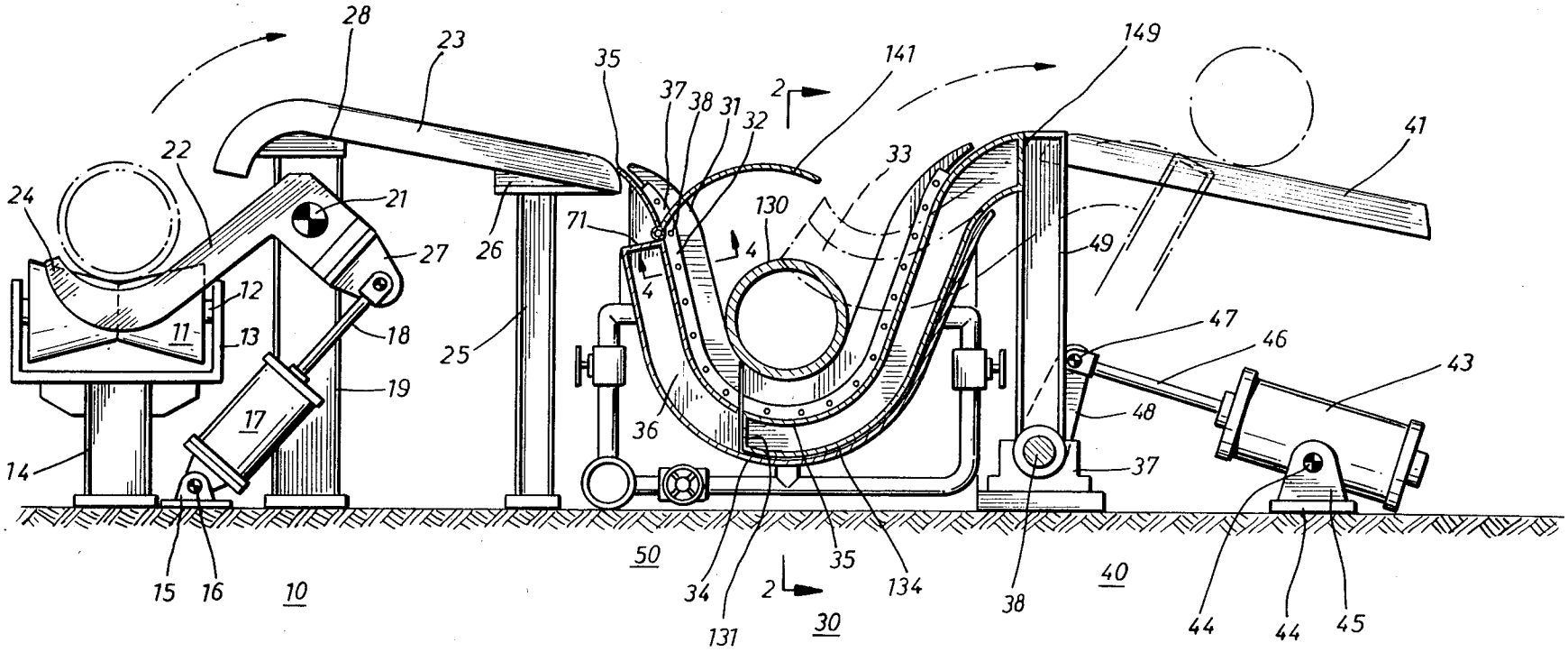
FIG. 7 is another cross sectional view taken from FIG. 1 along line 7—7.

Referring now to FIGS. 1 and 7 feed mechanism 10 comprises feed rolls 11. The feed rolls are each mounted on feed roll shafts 12 which are in turn journaled into jaws 13 mounted on base 14. A hydraulic cylinder 17 is pivotally mounted by means of pin 16 to base 15. Piston 18 of hydraulic cylinder 17 is connected at one end to flange or arm 27 which rotates on shaft 21. As best shown in FIG. 1, flange 27 is integrally but separately mounted to shaft 21 such that movement of piston 18 causes movement of flange 27 and so rotation of shaft 21.

A number of angular feed arms 22 are also integrally mounted along shaft 21. Each angular feed arm 22 has an arcuate portion 24 which is adapted to cradle the largest pipe to be heat treated. As best shown in FIG. 7, arms 22 are mounted such that when piston 18 is extended arcuate portion 24 of angular feed arm 22 is sufficiently below the level of feed rolls 11 to allow passage of the pipe along the feed rolls.

The angular feed arms 22 are adapted to rotate about shaft 21 such that upon rotation of shaft 21 the arcuate portion 24 of the angular feed arm cradles and lifts the pipe off of feed rolls 11 and onto feed ramps 23.

Each feed ramp 23 is mounted at one end on pedestal 28 of post or support 19 and at the other end on pedestal 26 of support 25. As shown in FIG. 7, the feed ramp 23 is inclined toward the pipe receptacle indicated generally at 30 so as to facilitate the transfer of the pipe from feed rolls 11 into receptacle 30.

Figure 5:
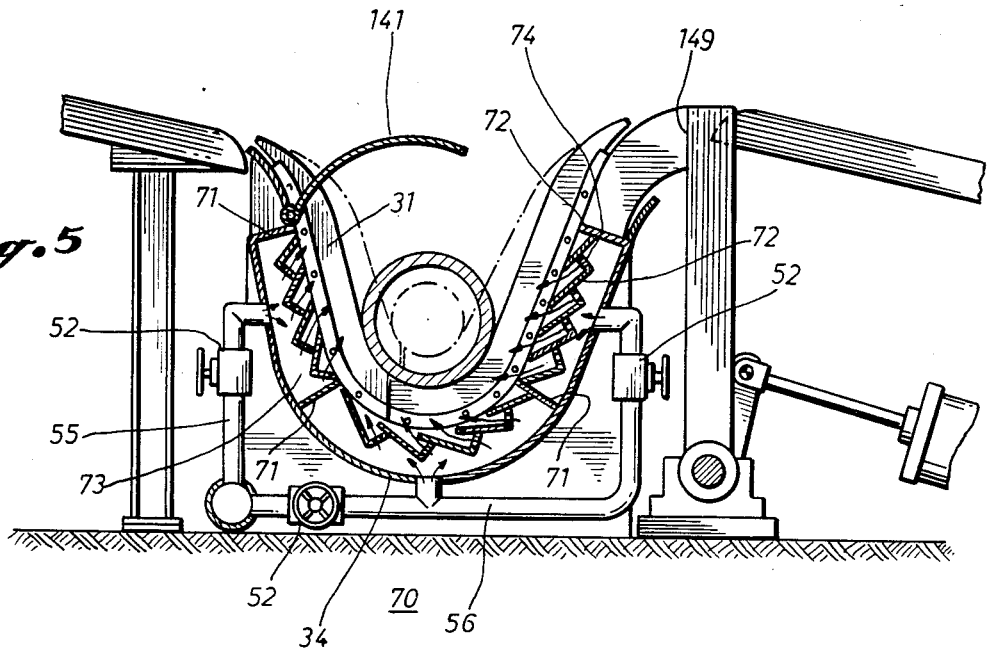
FIG. 5 is a cross sectional view taken along line 5—5 in FIG. 1.
Figure 6:
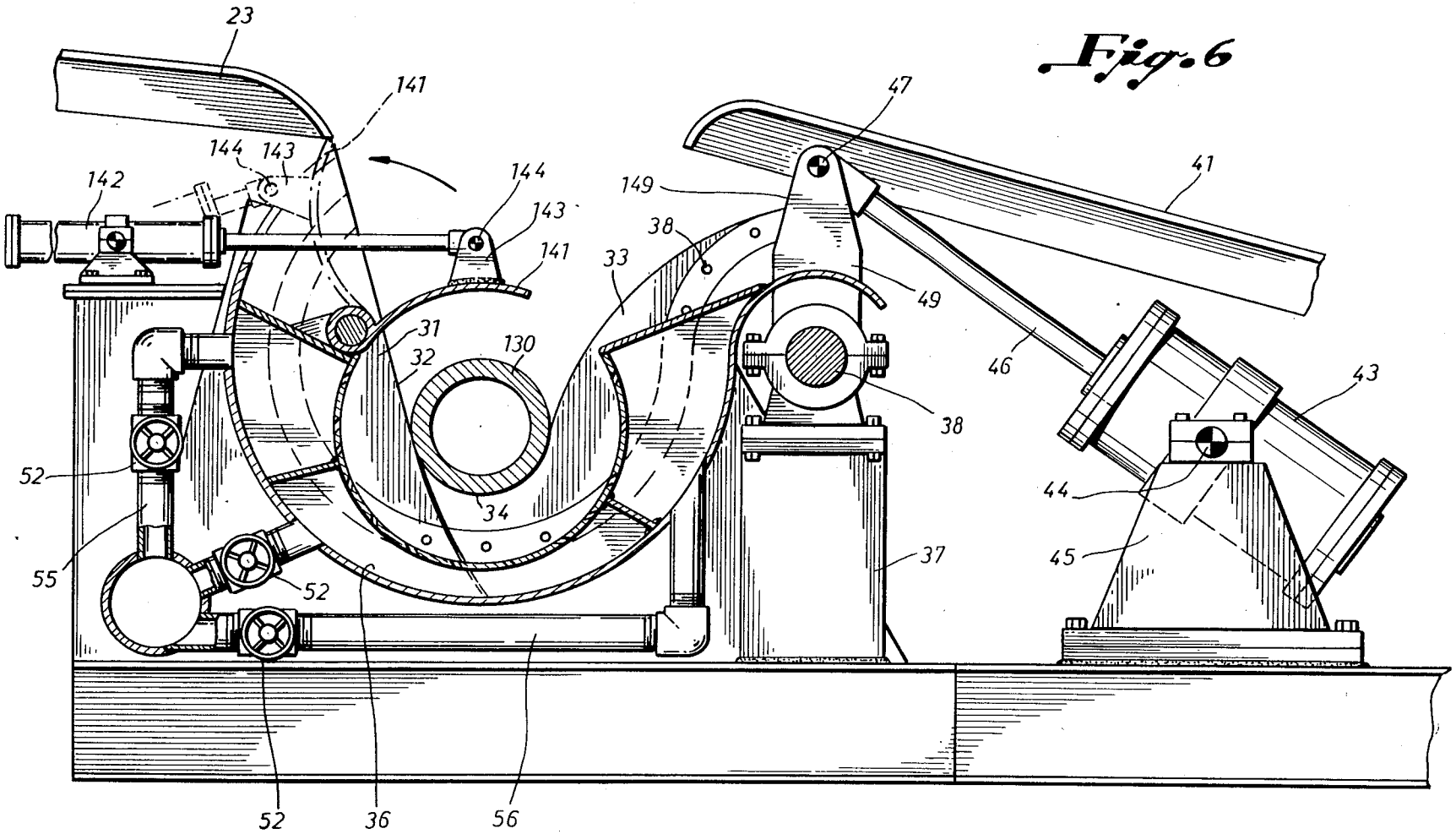
FIG. 6 is a cross sectional view of another embodiment of the present invention.

Pipe receptacle 30 comprises a U-shaped exterior wall 34 and a U-shaped interior wall 35 which serve to form an annulus 36 as best shown in FIGS. 5–7. The walls 34 and 35 extend the length of the receptacle 30. However, as indicated in FIGS. 1 and 5–7, the annulus 36 is segmented by walls 71 which run along the length of the receptacle 30 and extend radially from walls 34 or 134. Additionally, as shall hereinafter be more fully described, the annulus 36 is further divided along the length of the pipe receptacle 30 by partitions extending from wall 34 and 134 to wall 35. Walls 71 and the partitions in conjunction with walls 34 or 134 and 135 form exterior flow chambers 73.

As shown in FIGS. 5 and 7, the upper portion of walls 34 and 35 closest to unloading mechanism 40 is lower than the upper portion of wall 35 closest to feed mechanism 10. This arrangement allows excess cooling medium collecting in receptacle 30 to readily spill over the rim of wall 35 on the side opposite the unquenched pipe. The difference in height between the upper wall portions should be sufficient to allow the easy discharge of the cooling medium from receptacle 30. A trough (not shown) may be provided along the length of the receptacle to facilitate removal of the cooling medium as it spills over wall 35.

Interior U-shaped wall or surface 35 is provided with a number of ribs or quenching supports 31 along its length. Each rib 31 is mounted on interior wall 35 by means of rib flanges 37 which are integrally mated to wall 35. Bolts 38 serve to secure rib 31 to the flanges. As best shown in FIG. 1, at least the upper portion of each rib 31 is relatively narrow, such that only a minimal portion of the exterior surface of pipe 130 is in contact with the ribs 31 a the pipe rests on the ribs.

As shown in FIG. 7, the portions of wall 35, rib 31 and rib flanges 37 nearest feed mechanism 10 are each fixedly attached to each other such that they form a stationary member 32. The remaining portion of wall 35 is attached to interior curved wall 134 by means of side wall 171 and a portion of movable support 49 indicated at 149. Interior curved wall 134 rests on, but is not connected to, exterior wall 34. Thus, the remaining portions of wall 34, rib 31, and rib flange 37 form a movable arm 33 which is attached to and movable with movable support 49. As a portion of wall 35 forms an upper surface of movable arm 33 and stationary member 32, the movable arm 33 is flush with the surface of the receptacle 30 except for quenching support 31 and flanges 37.

Pipe receptacle 30 thus comprises an exterior wall 35 with a series of stationary portions or members 32 which are mounted on the side of the receptacle nearest the feed mechanism 10, and a series of juxtaposed movable segments or arms 33, each of which is located opposite a stationary member 32. Each movable arm 33 is provided with an arcuate section 34 which extends across the longitudinal axis of the receptacle 30 such that the pipe 130 is cradled in the arcuate section 34 when the pipe rests on ribs or quenching supports 31. The movable arms 33 in conjunction with stationary members 32 form partitions. These partitions serve to divide receptacle 30, including annuli 36, into compartments.

Although pipe receptacle 30 is generally illustrated as comprising U-shaped walls, the shape of receptacle 30 may be varied. By way of example, receptacle 30 might be more circular in shape as shown in FIG. 6 or might be rectangular or orthogonal along its cross-section. However, U-shaped or curved walls which roughly conform to the shape of the pipe being quenched are preferred for steel pipe, since the curvature of the walls assists in providing a circumferential flow about the exterior of the steel pipe.

The unloading mechanism 40 includes a hydraulic cylinder 43 which is pivotally mounted on base 42 by means of pin 44 and flange 45. Hydraulic cylinder 43 is equipped with a piston 46 which is connected to arm 48 by means of pin 47. As shown in FIG. 1, arm or flange 48 is integrally mounted to shaft 38 such that the movement of arm 48 causes the rotation of shaft 38.

Each movable support 49 is pivotally mounted on base 37 by means of shaft 38, which, as shown in FIG. 1, extends substantially the length of receptacle 30. As each movable support 49 is integrally mounted on shaft 38, rotation of shaft 38 causes the movement of each movable support 49. Movable arm 33 is in turn integrally mounted to the upper portion of movable support 49 by means of common wall 149. Thus, movement of piston 46 by hydraulic cylinder 43 causes the movement of movable arm 33 and hence pipe 130 from pipe receptacle 30 to ramp 41. Unloading mechanism 40 is also equipped with rollers 39 to facilitate movement of pipes from ramp 41 for further treatment.

In an alternate embodiment as shown in FIG. 6, shaft 38 could be mounted on the upper portion of post 49, thus dividing post 49 into a fixed lower portion integrally attached to base 37 and a pivotal upper portion 149 attached to movable arm 33.

As shown in FIGS. 5 and 6, the cooling medium source 50 comprises a series of pipes and valves adapted to supply a sufficiently pressurized cooling medium into flow chambers 73 formed in annulus 36 by walls 71 and portions of walls 34 and 35 or 134 and 35. Pipes 55 and 56 branch off from main feed pipe 51 to provide water or other appropriate quenching medium to the exterior quenching system 70. Valves 52 are provided to control the flow rate of the cooling medium to any given flow chamber 73. Although shown as being manually controlled, valves 52 may be linked to appropriate process controls.

The branch pipes 55 and 56 are located between each of the ribs 31 such that the flow of cooling medium may be varied in between divisions formed by stationary members 32 and movable arm 33. Thus, as shall hereinafter be more fully described the flow of cooling medium to any given segment of the exterior surface of pipe 130 may be varied since the flow rate and pressure of the cooling medium to each quenching compartment formed by stationary members 32 and movable arms 33 may be varied by means of valves 52.

Alternately, a greater number of branch pipes may be provided to vary flow of the quenching medium within any compartment. However, in accordance with the present invention, it is preferable to provide partitions between regions of varying flow rate where the controlling characteristic, such as thickness of a pipe wall, changes abruptly. By way of example, when quenching upset pipe a partition is preferably located at each boundary of the upset to ensure a relatively clear line of demarcation in the cooling regimes between the upset and the adjacent segment of the pipe.

A cross sectional view of an exterior quenching compartment is shown in FIG. 5. A series of flow chamber walls 71 serve to divide the annulus 36 created by walls 34 and 35 into flow chambers 73. The flow chambers 73 are equipped with a series of L-shaped deflector plates 72 having a plurality of inlets 74. The deflector plates run along the length of each flow chamber 73. They are substantially parallel to the pipe and angled in such a fashion that a cooling medium passing through openings or slots 74 in the wall of each deflector plate is directed around a segment of pipe 130. Openings or slots 74 are preferably arranged such that a cooling medium from pipes 55, 56 and 57 is also directed in a swirling motion. Thus, the series of deflector plates 72 are so arranged in each flow chamber 73 surrounding pipe 130 that the swirling cooling medium flows in a circumferential pattern about the exterior surface of the pipe 130. Wall 35 is provided with appropriate openings or cutout portions to accommodate the flow from the deflectors.

Interior wall 35 may also be provided with a plurality of threaded holes which place flow chambers 73 in communication with the interior of the receptacle 30. Nozzles may then be inserted in the threaded holes to direct the cooling medium from each flow chamber 73 in a circumferential flow pattern around the exterior surface of the pipe. As the holes may be filled with plugs, the number, as well as the type of nozzles, may be varied depending upon the specific flow pattern desired.

As another alternative, wall 35 may be provided with a series of openings, or slots as in FIG. 6 which are angled to properly direct the flow of the cooling medium around the pipe.

In accordance with the present invention, the arrangement of the deflector plates, nozzles or openings must be such as to provide a circumferential flow pattern of the cooling medium around the exterior of the pipe 130. The cooling medium is preferably directed so as to not impinge upon the pipe surface in order to facilitate uniform cooling of the pipe. As indicated in FIG. 6, a curved deflector plate 141 may also be provided to aid in completion of the circumferential flow pattern about the upper portion of pipe 130. A hydraulic cylinder and piston mechanism shown generally at 142 may be provided to move the flexible plate out of the path of the pipe 130 as it enters receptacle 30 from ramp 23. As shown, the upper deflector plate 141 could be pivotally attached to interior wall 35 so as to form a continuation of wall 35 extending out and over the central axis of receptacle 30. Hydraulic cylinder and piston mechanism 142 could be attached to a shaft 144 by means of a series of flanges 143 such that retraction of the piston would cause upward and outward movement of the deflector plate 141.

Ribs or quenching supports 31 are adapted to closely conform to the lower circumference of the pipe 130 as it rests on each rib. Additionally, each of the upper segments of the quenching supports is adapted to facilitate movement of a pipe in and out of the receptacle.

As the type of rib or quenching support may differ along the length of the receptacle 30, pipes of varying sizes and diameters may be accommodated. Additionally, any given quenching support or rib may be readily detached by removal of the pins 38 and replaced with a different quenching support or rib. Thus, the system may be adapted to handle varying sizes of pipe with variable circumferences along their length.

By way of example, the ribs closer to the center may accommodate a pipe with an outside diameter of 5 inches (12.7 cm) while ribs able to accommodate a pipe with an outside diameter of 5.875 inches (14.9 cm), may be inserted at the end of the receptable. Thus, 5 inch (12.7 cm) pipe with an external upset of 5.875 inches (14.9 cm) may be secured along its length within the receptacle 30.

It may be preferable in some instances to provide different size receptacles 30 to accommodate varying ranges of pipe. For example, one unit might have a receptacle adaptable to accept pipe with outside diameters of 4.5 to 14 inches, while a smaller unit might be adaptable to accept pipe ranging from 1.5 to 4.5 inches in outside diameter.

Figure 8:
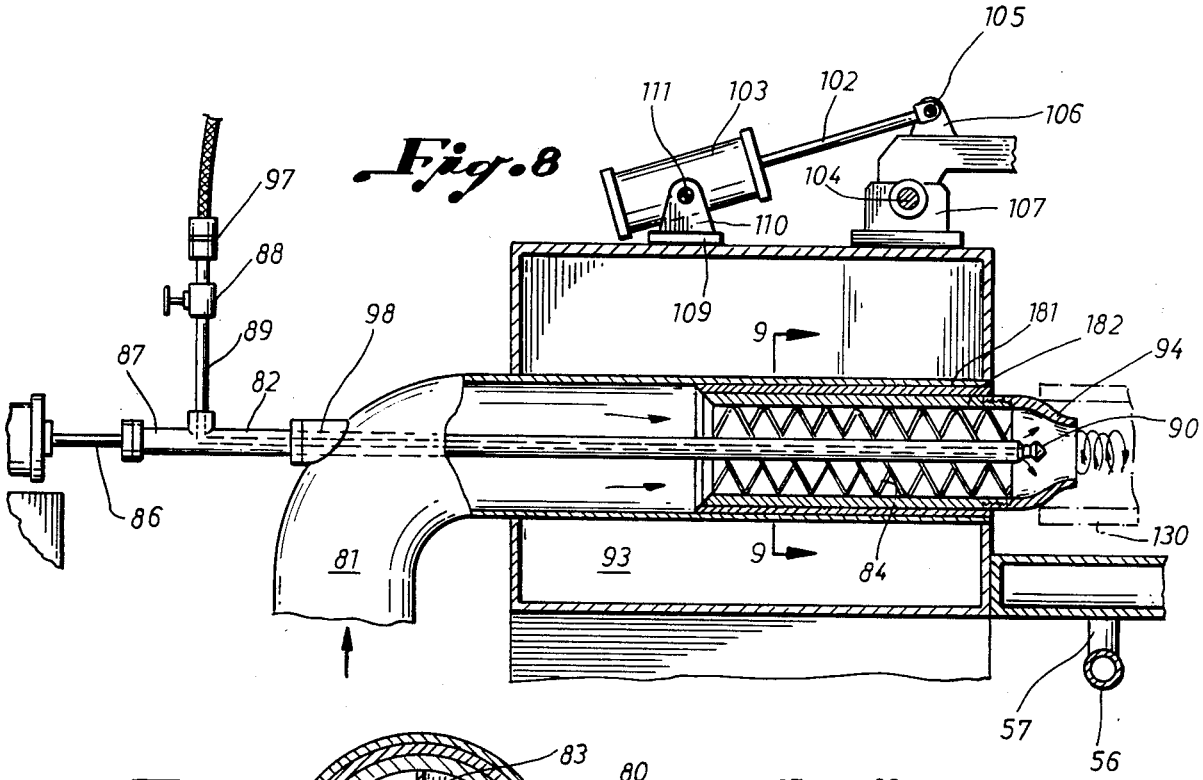
FIG. 8 is a vertical cross sectional view of a portion of an internal quenching means.

Referring now to FIG. 8, the internal quencher 80 comprises a cooling medium feed conduit 81 and a gas feed conduit 82 mounted in cylindrical rod 87. Cooling medium feed conduit 81 is mounted in frame 93 and is equipped with an internal fixed sleeve 181, which is integrally mated to the interior wall of conduit 81. Movable sleeve 182, which has a tapered end portion 94, is telescopically mated with the internal sleeve 181. The tapered end portion 94 is adapted to sealingly engage the inlet of pipe 130.

It is preferable that vanes 182 remain essentially stationary. For example, when the vanes are integrally mounted in movable sleeve 182, the sleeve should be mounted to avoid substantial rotation of the vanes by the swirling cooling medium passing through the sleeve. By way of example, the sleeve 181 could be fitted with grooves to accept flanges extending from movable sleeve 182.

Figure 9:
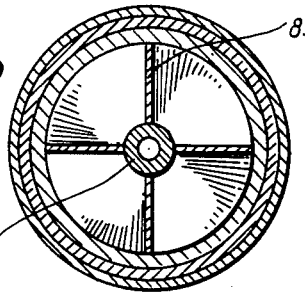
FIG. 9 is a partial cross sectional frontal view taken along line 9—9 from FIG. 8.

Cylindrical rod 87 is integrally mounted in movable sleeve 182 by means of helical vanes 84, which are integrally attached along the interior surface of sleeve 182. As shown in FIG. 9 cylindrical rod 87 is also supported by rods 83 which are mated into sliding tube 182.

The gas feed conduit 82 is connected to conduit 89 such that the flow of gas through conduit 82 may be controlled by shut off valve 88. Gas feed conduit 82 is supported by cylindrical rod 87 along its length. Cylindrical rod 87 is telescopically mated into sealed housing or stuffing box 89 which is attached at one end to piston 86. Thus, movement of piston 86 causes the movement of rod 87 and hence conduit 82 and sleeve 182. Conduit 89 is attached to a flexible hose 150 to accommodate movement of the gas feed conduit 82 with cylindrical rod 87.

Figure 10:
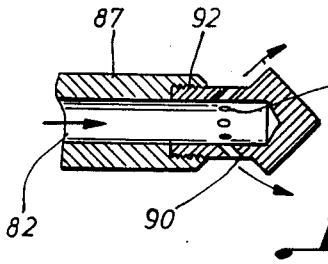
FIG. 10 is a closeup view of gas conduit outlet of the internal quenching means.

The outlet of gas feed conduit 82 is equipped with a plug or nozzle 90 which is shown in more detail in FIG. 10. The plug 90 is threaded into cylindrical rod 87 by means of threads shown at 92. As the end of feed conduit 82 is equipped with apertures 91 the flow of gas through conduit 82 occurs around the tapered end portion of plug 90 as shown by the arrows in FIG. 10.

In accordance with the present invention, the spiral vanes are preferably at an angle of approximately 35 degrees with the horizontal, particularly when water is used as a cooling medium. This angle will impart a relatively long spiral to the flowing water and so reduce the time the water travels the length of the pipe. Additionally, multiple vanes are preferred in order to aid in imparting sufficient turbulence to the cooling medium. However, the arrangement of the vanes may be varied depending upon the exact nature of the helical motion desired in the cooling medium. For example, variations in the type and amount of cooling medium, the type of pipe being quenched, the severity of the quench desired and the amount of gas to be injected may all affect the exact configuration chosen for the vanes.

A clamp indicated generally at 100 is provided to hold the pipe 130 in place. The clamp comprises an arm 101 and a clamping member 108. Although not shown, the lower portion of clamping member 108 is contoured to engage the upper surface of pipe 130 when horizontal arm 101 is lowered into the position shown in FIG. 2. Arm 101 is rotatably mounted on clamp base 107 by means of pin 104. Piston 102 of hydraulic cylinder 103 is attached by means of pin 105 to flange 106. As flange 106 is integrally mounted on arm 101 the movement of piston 102 causes the upward movement of arm 101. The movement of piston 102 and arm 101 is further facilitated by the pivotal mounting of hydraulic cylinder 103 onto flange 110 by means of pin 111. As shown in FIG. 8, hydraulic cylinder 103 is mounted on base 109 which rests on the top of frame 93.

Referring again to FIGS. 1–10, in operation a steel pipe 130 is heated to a temperature sufficiently above its austenizing temperature to avoid cooling below its critical transformation temperature prior to entering the receptacle. The pipe is then placed in a position substantially parallel to receptacle 30 by means of feed rolls 11. Piston 18 of hydraulic cylinder 17 is then retracted causing angular feed arms 22 to rotate about shaft 21 such that the arcuate portion 24 of each angular feed arm 22 comes into contact with and cradles the underside of pipe 130 at various points along its length. The pipe 130 is then lifted by angular feed arms 22 onto feed ramp 23, whereupon the pipe 130 rolls down quenching support 31 and into the lower portion of pipe receptacle 30.

While the pipe 130 is being moved into position on feed rolls 11, the cooling medium source 50 fills receptacle 30 with water. Thus, as the hot pipe rolls into the pipe receptacle 30, its fall is cushioned by the water as it is received by ribs or contoured pipe supports 31 which are adapted to cradle the lower portion of the pipe. As the diameter of the ribs may be varied along the length of receptacle 30, pipe of varying diameter or size may be cradled along its length and rest securely in arcuate portions 34 of each quenching support.

Once the pipe is resting in receptacle 30, hydraulic cylinder 103 is activated and piston 102 extended, thus causing arm 101 to lower into a horizontal position as it rotates about pin 104. This in turn brings the lower contoured portion of clamping member 108 into contact with the upper portion of pipe 130. By means of hydraulic cylinder 103, piston 102 and arm 101, clamping member 108 exerts a downward force on the end of the cradled pipe 130. As the pipe is cradled into arcuate sections 34 and clamping member 108 is contoured to the upper surface of the pipe, only one clamping member is needed to substantially hold the pipe in place against the force of the cooling medium as it impacts the pipe 130. The clamp 100 also serves to hold the pipe in place against the movement of tapered end portion 94 of sleeve 182.

As the pipe 130 is being clamped into place by means of clamp 100, cylinder rod 87 and hence feed gas conduit 82, is moved forward by hydraulic cylinder 85 and piston 86. The movement of cylindrical rod 87 through sealed housing or stuffing box 89 in turn causes the forward movement of movable sleeve 84. As the movable sleeve 84 travels forward toward the inlet of pipe 130 it slides through fixed sleeve 181 until the tapered end segment 94 sealingly engages the inlet of pipe 130 as shown in FIG. 8.

Once the pipe is thus positioned and the internal quencher 80 is brought into contact with the pipe inlet, water is fed through feed conduit 81. Concurrently therewith valves 52 are opened to deliver the water through deflector plates 72 or appropriately placed nozzles and hence in a circumferential flow pattern around the exterior of pipe 130, while shut off valve 88 is opened to allow gas from flexible conduit 150 to pass through conduit 89 and gas feed conduit 82 and hence into the water passing through tapered end portion 94 of sleeve 182. As the water must pass through helical vanes 84, the water enters the inlet of pipe 130 in a helical flow pattern. Additionally, the water is injected with a sufficient amount of gas, such as air, to aerate the water and insure sufficient turbulence to avoid the creation of steam and vapor pockets and so prevent nonuniform cooling and otherwise facilitate heat transfer from the pipe wall into the water.

In accordance with one aspect of the present invention, the internal and external quenches preferably begin almost simultaneously in order to promote a more uniform cooling sequence across the thickness of the pipe wall. Thus, the circumferential flow of water from the flow chamber 73 and inlet 94 preferably begins within a few tenths of a second or less after the pipe 131 is rolled into receptacle 30. Additionally, the flow of water from flow chambers 73 may begin before the pipe leaves feed rolls 11. In this regard it is noted that the continual replenishment of the water serves to remove impurities and maintain the water temperature at the desired level.

In accordance with the present invention, it is important to maintain the flow from deflector plates 72 into each of the exterior quenching compartments formed by member 32 and movable arm 33 in a substantially circumferential pattern such that the flow of water moves along the exterior surface of the pipe 130. The water should generally not directly impinge on the pipe if uniform cooling is to be achieved.

The pressure of the water entering from valves 52 should be sufficient to create sufficient turbulence so that pockets of steam or vapor are removed as the water flows circumferentially along the pipe surface. Additionally, the flow rate should be such as to provide a fairly rapid turnover of the water in each compartment in order to prevent the circumferentially flowing turbulent water within each compartment from rising above a specified temperature. More particularly, the flow rate is preferably such as to keep the water at an overall temperature of about 80° F. (27° C.) and preferably 70° F. (21° C.) or less, since the cooling power of water decreases rapidly as water temperature increases beyond about 75° F. (24° C). In fact, this loss of cooling power is almost expotential such that water at a temperature of 120° F. (49° C.) has only about 20% of the cooling power of water at 70° F. (21° C.). However, use of water at a higher temperature can still prove advantageous when compared to prior art processes using water of a similar temperature due to the favorable circumferential flow pattern created by the deflector plates and the high turnover of the water in each compartment.

Other mechanisms, such as conduits placed in receptacle 30, may be provided in place of the difference in receptacle wall height to facilitate the appropriate replenishment of the cooling medium. However, as indicated, the mechanism should be able to provide sufficient turnover of the cooling medium to properly control temperature.

The water flowing into the interior of the pipe is preferably at a pressure of about 100 psi and should be within the range of about 60 to 110 psi prior to injection of the gas. This is believed to be a high enough pressure to provide needed turbulence and allow the gas to force the water to adhere more closely to the interior pipe wall as it passes through the pipe.

The internal and external quenches are continued for a predetermined amount of time. The time of the quench, the rate of flow of the cooling medium through flow chambers 73 and cooling medium feed conduit 81, and the flow of gas through gas feed conduit 82 may all be regulated during the quenching operation to provide a proper cooling sequence for the pipe 130. To this end thermocouples and other sensors (not shown) may be employed along with appropriate process controls to control the flow of the cooling medium and gas in order to control the cooling sequence undergone by the pipe.

Upon completion of the cooling sequence hydraulic cylinder 43 retracts piston 46 thus causing movable support 49 and integrally mounted movable arm 33 to rotate about shaft 38. As the arcuate section 34 of movable arm cradles lower portion of pipe 130, pipe 130 is lifted up out of the receptacle 30 and onto ramp 41. The quenched pipe then rolls down ramp 41 and onto rollers 39 where it may be forwarded for further processing, such as tempering.

As will be appreciated by one skilled in the art having the benefit of this disclosure, given the variable flow rates and other conditions attainable in each compartment, the present invention is particularly suitable for quenching internal and external upset pipe, casing or tapered steel pieces. Of course, in the case of pipe with uniform thickness the flow rates do not necessarily have to be varied. Additionally, steel pipe with walls of greater thickness or lower alloy content may now be successfully heat treated.

The process and apparatus of the present invention may also be used to treat tool joints after they are welded to a tubular member such as drill pipe. Thus, the tool joint and pipe may be of similar composition and the tool joint need not have a higher alloy content to withstand the temperature changes caused by welding. For example, a tool joint, which may be thought of as a sleeve of additional thickness added to the end of a pipe, may first be welded to a piece of pipe. Thereafter, the pipe-tool joint combination may be heated above its critical austenizing temperature and quenched in accordance with the present invention.

As will be appreciated by one skilled in the art having the benefit of this disclosure a number of modifications may be made to the foregoing apparatus and method within the spirit of the present invention. For example, receptacle 30 may be varied in shape and the number of flow chambers and deflector plates may be varied depending on the source of the cooling medium, the maximum and minimum thickness of pipe or other object to be quenched by a given unit and other variables. Additionally, although the cooling medium is preferably water and the gas is preferably air, any variety of cooling media or gases may be employed or interchanged within the spirit of the present invention. Furthermore, the interior quenching means 80 may be used with conventional quenching techniques. Similarly, the exterior quenching means 70 may be used to quench the exterior of the pipe while conventional quenching techniques are used on the interior. However, it is preferable in most cases to use both in order to facilitate uniform and rapid heat transfer from the pipe to the cooling medium and otherwise take full advantage of the present invention. Also the nature and extent of the partitions created by movable arm 33 and fixed member 32 or the number of compartments may be varied depending upon the cooling sequence or other effects desired along segments of the pipe.

Further modifications and alternative embodiments of the apparatus and method of this invention will be apparent to those skilled in the art in view of this description. Accordingly, this description is to be construed as illustrative only and is for the purpose of teaching those skilled in the art the manner of carrying out the invention. It is to be understood that the forms of the invention herewith shown and described will be taken as the presently preferred embodiments. Various changes may be made in size, shape and arrangement of parts. For example, equivalent elements or materials may be substituted for those illustrated and described herein, parts may be reversed, and certain features of the invention may be utilized independent of the use of other features, all of which would be apparent to one skilled in the art after having the benefit of this description of the invention.

What is claimed is:

1. An apparatus for quenching a steel pipe comprising:

a receptacle adapted to receive the pipe;

an exterior quenching means in communication with the receptacle, the exterior quenching means being adapted for separately directing a cooling medium in a substantially circumferential flow pattern at variable flow rates around separate exterior segments of the pipe while allowing rapid turnover of cooling medium in the receptacle;

an interior quenching means for passing a cooling medium through the interior of the pipe, the interior quenching means comprising:

a cooling medium conduit adapted to introduce a cooling medium into the pipe; and a gas injection conduit adapted to blow a gas into the cooling medium as it enters the pipe from the cooling medium conduit to encourage sufficient turbulence in the cooling medium as it passes through the pipe to facilitate heat transfer from the pipe to the cooling medium.

2. The apparatus according to claim 1 wherein a cylindrical plug with a plurality of apertures along its length is mated with the outlet of the gas injection conduit.

3. The apparatus according to claim 1 wherein the gas injection conduit is telescopically mated with the cooling medium conduit.

4. The apparatus according to claim 1 wherein the cooling medium conduit is adapted to seal the inlet of the pipe.

5. The apparatus of claim 1 further comprising a clamp engageable with the pipe to prevent the substantial movement of the pipe as it undergoes quenching.

6. The apparatus of claim 5 wherein the clamp comprises a single clamping member adapted to engage one end of the pipe.

7. The apparatus of claim 1 further comprising an upper deflector plate mounted on the receptacle and adapted to facilitate the circumferential flow of the cooling medium about the upper exterior surface of the pipe.

8. An apparatus for quenching the interior and exterior of a steel pipe comprising:

an exterior quenching means for contacting the exterior surface of the pipe with a circumferential flow of cooling medium;

an interior quenching means comprising a cooling medium conduit located along the axis of the pipe and having a tapered outlet adapted to direct cooling medium into the interior of the pipe;

a gas conduit telescopically mated into the cooling medium conduit add having a gas conduit outlet near the tapered outlet of the cooling medium conduit, the gas conduit outlet being adpated to inject a gas from the gas conduit into the cooling medium; and a series of helical vanes mounted in the interior of the cooling medium conduit and adapted to impart a helical flow pattern to the cooling medium leaving the tapered outlet.

9. The apparatus of claim 8 wherein the vanes are mounted at an angle of about 35 degrees with the horizontal.

* * * * *